US005330386A

United States Patent [19]

Calandra

[11] Patent Number: 5,330,386

[45] Date of Patent: Jul. 19, 1994

[54] METHOD AND DEVICE FOR VENTILATING A HOME

[76] Inventor: Thomas P. Calandra, 213 Phil Ellena, Cherry Hill, N.J. 08034

[21] Appl. No.: 35,802

[22] Filed: Mar. 23, 1993

[51] Int. Cl.[5] ..... F24F 7/007; F24F 13/18

[52] U.S. Cl. ..... 454/341; 454/339; 454/354; 454/358

[58] Field of Search ..... 49/50, 70, 369, 371, 49/390, 394; 52/473, 656.1, 475; 454/270, 330, 347, 349, 352, 358, 359, 363, 339, 341

[56] References Cited

U.S. PATENT DOCUMENTS

| | | | |
|---|---|---|---|
| 1,381,630 | 6/1921 | Goodrich | 454/363 |
| 2,084,807 | 6/1937 | Hueglin . | |
| 2,496,773 | 2/1950 | Brown . | |
| 3,858,355 | 1/1975 | Root | 454/330 |
| 4,286,508 | 9/1981 | Seebo, II . | |
| 4,287,815 | 9/1981 | Henderson | 454/347 |
| 4,412,478 | 11/1983 | Osher et al. . | |
| 4,501,194 | 2/1985 | Brown . | |
| 4,628,802 | 12/1986 | Steiner et al. . | |
| 4,770,087 | 9/1988 | Danley et al. . | |
| 4,784,049 | 11/1988 | Steiner et al. . | |

FOREIGN PATENT DOCUMENTS

| | | | |
|---|---|---|---|
| 1368406 | 6/1964 | France | 454/358 |

*Primary Examiner*—Harold Joyce
*Attorney, Agent, or Firm*—Thomas A. Lennox

[57] ABSTRACT

A method of installing a ventilation device through existing plywood door closures of accesses to attic spaces with roof fans in homes includes a frame with louvers across a central opening closed by two doors hingeably attached to be opened and closed with a hook rod interconnecting with eye bolts on the doors, the entire device being insulated to reduce heat loss during the cooler seasons.

8 Claims, 2 Drawing Sheets

20
24
22
12
14
10
16
18

14
16
20
24
26
12
22

34
28

7
10
30
32
20
22
7
30
12
24
34
36

METHOD AND DEVICE FOR VENTILATING A HOME

BACKGROUND OF THE INVENTION

This invention involves the installation of a ventilating system in existing homes. More specifically, the invention involves installing a ventilator opening through an already existing access opening through a ceiling to attic space to provide ventilation from the living quarters into the attic space.

For many modern homes, there is no open stairway to the attic. In many of these styles, the attic space is described as a "crawl space" as a person cannot stand upright in at least a major portion of the area. On the other hand, the area is used as storage and an access opening is provided. For some homes, a ladder/stairway is attached on the top of a hinged door that pulls downwardly to expose the opening. A folded wooden ladder stairway on the top of the door folds downwardly to allow easy access through the opening. These units are constructed with a plywood panel interfitting into the opening constructed when the house was built. For some homes, particularly where the crawl space is of limited storage capacity, a framed opening is constructed in the ceiling into which is dropped a sheet of plywood. When access to the attic space is necessary to reach an air conditioning air handler unit, electrical lines or the like, the panel is merely lifted upwardly from below and put aside so that the attic space can be entered using a step ladder.

Ventilation systems have been provided such as shown in B. D. Brown U.S. Pat. No. 2,496,778 with a fan installed in an opening cut into the ceiling of the living space opening into the attic area. The device includes a folding stairway which attaches slats to the stairway members to close off the opening when the stairway is not in use and the fan pulls air through the openings between the slats. In Steiner et al U.S. Pat. No. 4,628,802 a house fan is installed on rafter members drawing air through an opening in the ceiling covered by a shutter assembly. In Seebo II U.S. Pat. No. 4,286,508, a combination staircase and attic fan is installed. In Brown U.S. Pat. No. 4,501,194 a house attic fan is installed in a frame between rafter members opening through the ceiling. All of these units require a new opening through the ceiling into the attic area requiring that a person cut a whole, generally changing the structural components, and frame it to receive the house fan. In some of these devices, the opening through the ceiling must be constructed at the time the house is constructed or involve the owner in a substantial reconstruction of the ceiling. Danley et al U.S. Pat. No. 4,770,087 describes a garage door ventilator, with louvers and a screen attached on the outside of the door with a hinged closure panel on the inside of the door.

The problem with these devices providing ventilation, with or without a fan is the major expense of installation of the ventilating opening through the ceiling. Most home owners would not be capable of installing such devices requiring substantial expenditures of professional tradesmen. Further, none of the devices or methods of installation in the prior art attain the objects described hereinbelow.

SUMMARY OF THE INVENTION

Attic spaces including crawl spaces and larger areas which accommodate storage all require ventilation usually through the sidewalls close to the peak of the house. It is extremely common to install fans through the roof of the home to draw hot air out of the attic area and draw cooler air through the ventilator openings into the attic area. This air movement reduces the temperature in attic space thus reducing the cost of cooling of the home below as there is substantial conductive heat gain through the floor and ceiling of the living quarters below. Further, the reduction in temperature increases the life of the asphalt shingles or other roofing materials. This system does not affect air flow from the living quarters. Since the attic space is commonly dusty and usually contains substantial quantities of insulation, usually spread close to the edge of the frame of the attic opening, it is not practical to open the standard hinged door or plywood panel to achieve ventilation. Further, the hinged doors with the ladder combination would be in the way during the evening hours. It is a substantial bother and potential safety hazard to have to climb up on the ladder to remove the panel every evening.

This invention is directed to use in living quarters, not only with an attic space, but also a fan installed through the roof as described immediately hereinabove. However, with the installation of the device of the present invention, the air flow provided by this fan can be effectively used to draw air from the living quarters below as well as carrying out its normal task of reducing the temperature in the attic space. For the operation of this invention, it is not necessary to install large fans either in the attic space walls or directly into a specially constructed aperture through the ceiling to the attic space. With this invention, previously installed roof fans provide effective ventilation. The system of the present invention is particularly effective the during the day time hours when the air conditioning system of the home is being operated. The air conditioning system is greatly enhanced and the efficiency improves by the utilization of the present invention. With the ventilation opened a continuous air draft is provided from the living quarters into the attic space and out through the roof fan. Particularly in two story homes, this greatly improves the efficiency and may eliminate the necessity of two air conditioning units one for the first floor and one for the second floor. The draft flow into the attic space also will substantially reduce the accumulation of interior pollutants.

This invention utilizes the already existing panels closing the openings to the attic spaces. The device of the present invention is provided and installed over a cut out opening cut right through the plywood panel. Thus, for installation, all the homeowner need do is to utilize a saw to cut the opening in the panel, any rough edges of which are covered by the frame of the present invention. Therefore, a homeowner with only very limited handyman skills can install the device of the present invention to achieve handy easy to use ventilating opening to the attic space.

It is an object of the present invention to provide a ventilating device which can be easily installed by a person of limited handyman skills, requiring only that an opening be cut into an existing plywood panel.

It is a particular object of the present invention to provide a device which will interfit over an access panel providing ventilation through that panel without interfering with any devices attached on the top side, such as a ladder.

It is an additional object of the present invention to provide an air ventilating device that can be easily closed or opened without the necessity of climbing a ladder to reach the ventilating device.

It is a further object of the present invention to provide a ventilating closure device that provides full air flow sealing and heat conductive insulation when closed to avoid significant heat loss during the cooler seasons, when the ventilation is not necessary.

An embodiment of the invention is a method to provide ventilation in a living structure through a ceiling above which is an attic space having a roof fan pulling air from said space to the outside, wherein there is an access opening through the ceiling to the attic space. The access opening is open and closed with a closure means that includes a panel member. The method includes providing a ventilating device. The ventilating device includes a frame member having outside dimensions smaller than that of the panel member, two opposite ends and a first surface a central opening through the frame member and at least one door-hingeably attached proximate one end of the frame member swinging outwardly from the frame member to an open position opening the central opening and swinging back to the frame member to a closed position to close the central opening. The ventilating device further includes screen means across the central opening to at least partially obstruct sight through the central opening while allowing essentially unobstructed air flow. The ventilating device also includes closure means to hold the door in the closed position, and opening means to allow a person to open the door without climbing. The method further includes cutting an opening through the panel member of a size and shape proximate that of the central opening through the frame member of the ventilating device. The method then includes placing the first surface of the ventilating device against the frame member aligning the central opening with the opening through the panel member, and attaching the frame member to the panel member.

It is preferred that the central opening be rectangular and the cutting through the panel member be a rectangular opening. It is further preferred that the closure means include a magnet and closing the door includes swinging the door upwardly to engage the magnet. It is further preferred that the ventilating device include a pair of doors, one door hingeably attached proximate one end of the frame and the remaining door hingeably attached proximate the opposite end of the frame, the combination of the two doors closing the central opening of the frame. It is further preferred that the opening means include a member having an eye opening, the member extending downwardly from the door and a hand held rod member with a hook on an end, and the method further includes opening the door by engaging the hook in the eye opening and pulling to open the door. It is more preferred that the opening means include a pair of members each having an eye opening, the members extending downwardly from opposite doors and a hand held rod member with a hook on an end, and the method further include opening the doors by engaging the hook on one of the doors in the eye opening and pulling to open the door and then engaging the hook on the remaining door in the eye opening and pulling to open the remaining door.

It is also preferred that the ventilating device further include at least one insulation panel on a surface of the door facing the same direction as the first surface of the frame and the method further includes opening the door.

Another aspect of the invention is a ventilating device that includes a rectangular frame member two opposite ends with a rectangular central opening through the frame member. The device further includes a pair of doors, a first door hingeably attached proximate one end of the frame swinging outwardly in a first direction from the frame member to an open position and a second door hingeably attached proximate the opposite end of the frame swinging outwardly in the first direction from the frame member to an open position, both doors swinging back to the frame member to a closed position to close in combination the central opening of the frame. The device also includes screen means across the central opening to at least partially obstruct sight through the central opening while allowing essentially unobstructed air flow. The device further includes closure means to hold the door in the closed position said means including at least one magnet on each door position to engage the frame member when each door is swung to the closed position. The device also includes opening means to allow a person to open the doors without climbing said means including a pair of members each having an eye opening, each of the members attached to and extending in the first direction from each of the doors proximate an end furthest away from the hingeable attachment and a hand held rod member at least one and half feet long with a hook on an end.

DESCRIPTION OF PREFERRED EMBODIMENTS

Figure 1:
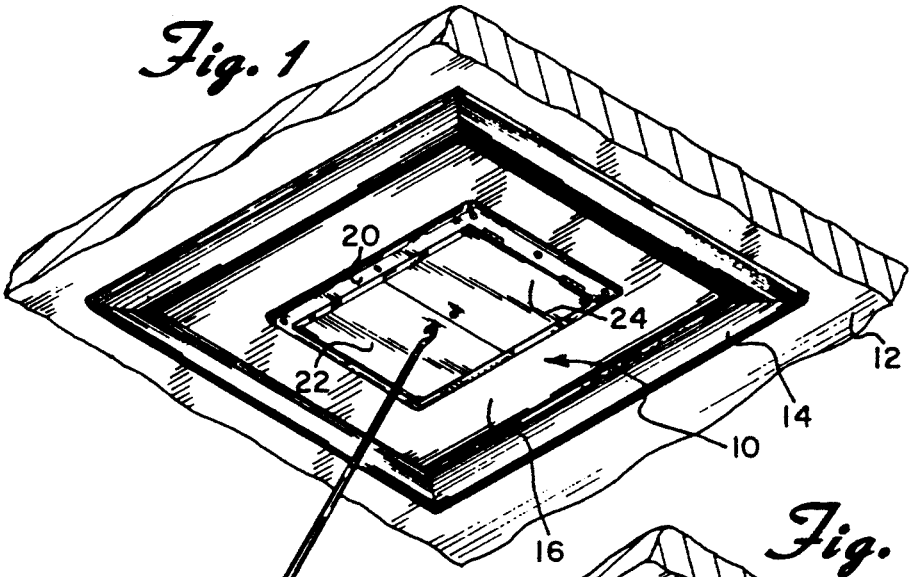
FIG. 1 is a cut away perspective view of a standard opening through a ceiling to an attic area with a device of the present invention installed on the bottom surface of the wood panel in the closed position.
Figure 2:
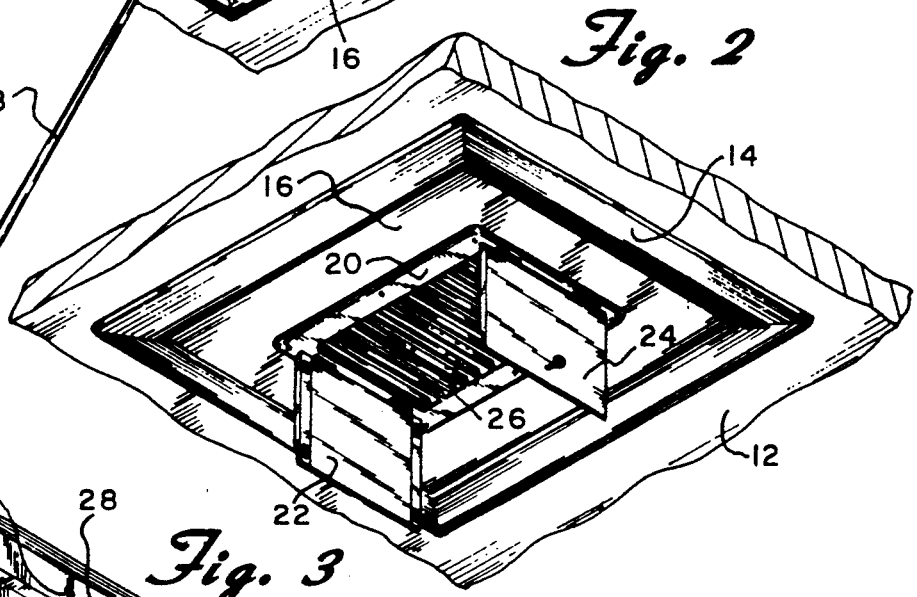
FIG. 2 is a view thereof with the doors of the device opened for ventilation.
Figure 3:
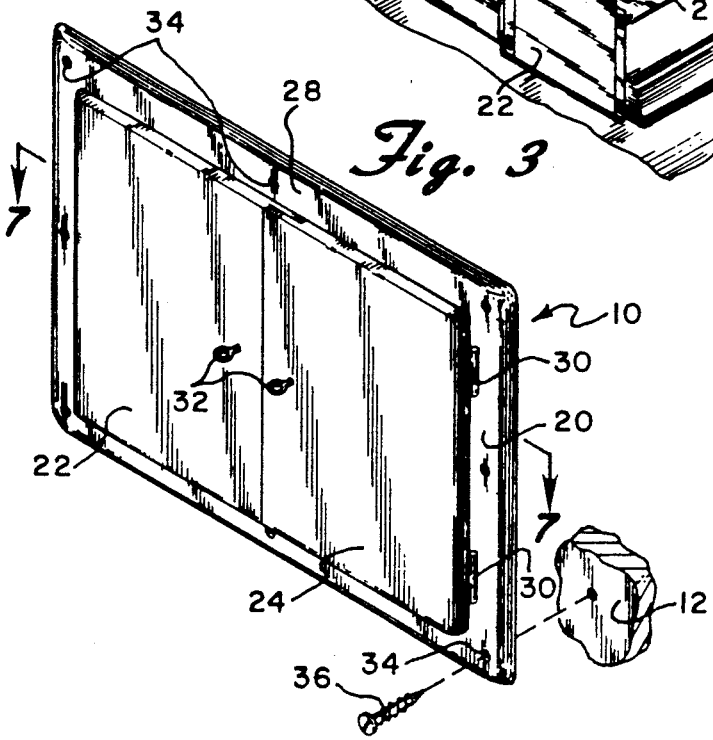
FIG. 3 is a top bottom right side perspective view of the device illustrated in FIGS. 1 and 2.
Figure 4:
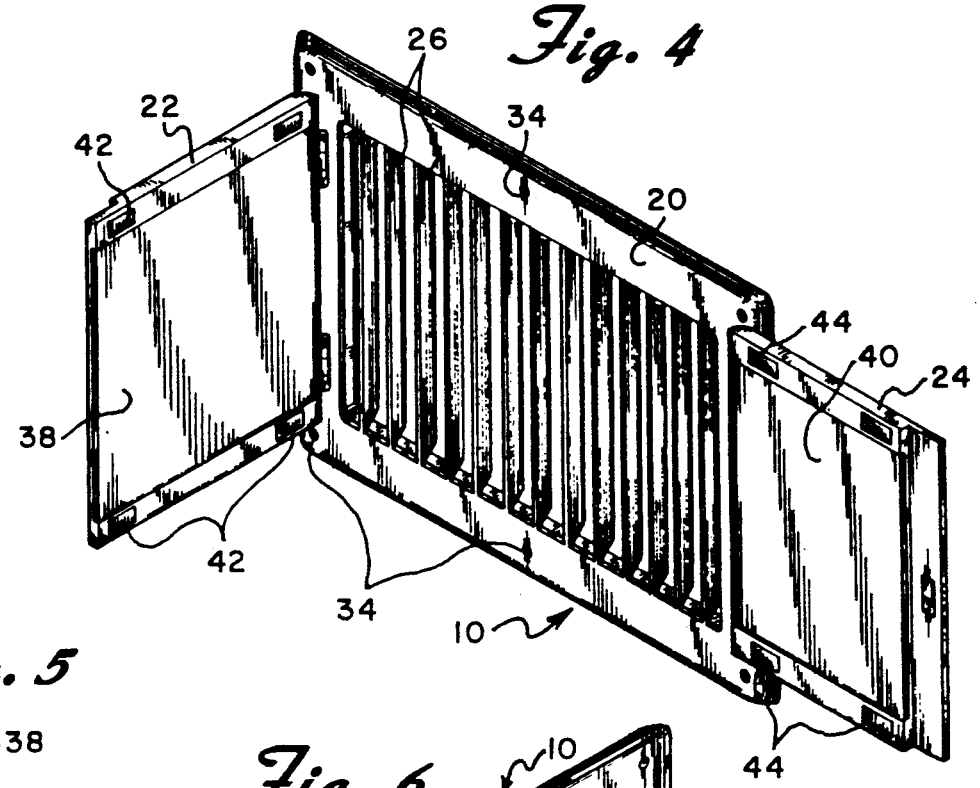
FIG. 4 is a similar view thereof with the doors opened to display it in the ventilating position.
Figure 5:
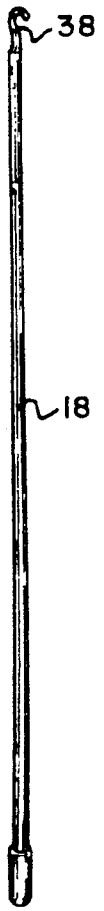
FIG. 5 is an enlarged view of the opening and closing device illustrated in FIG. 1.
Figure 6:
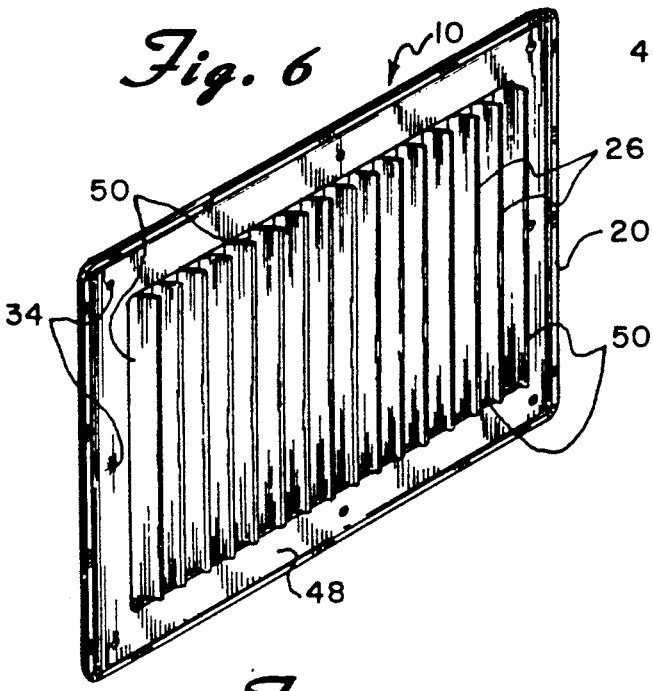
FIG. 6 is a top right side rear perspective view of the device illustrated in FIGS. 3 and 4.
Figure 7:
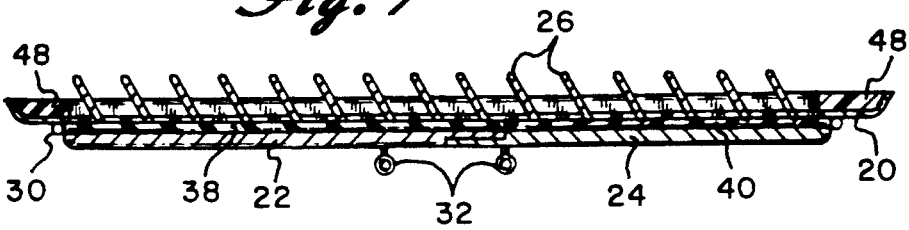
FIG. 7 is a cross-sectional view taken along lines 7—7 of FIG. 3.

In FIGS. 1 and 2, device 10 is shown installed on plywood panel 16 resting on the inside edges of sheet metal frame 14 framing an opening in ceiling 12. In FIG. 1, device 10 is shown closed while in FIG. 2, doors 22 and 24 have been swung downwardly to hang opening air flow through louver/screen 26 using hook wand 18. As further shown in FIGS. 3 and 4, device 10 is constructed of metal rectangular frame 20 onto which doors 22 and 24 are hingeably attached through hinge members 30. The doors meet in the center with overlapped joint 28. The doors are also constructed of metal sheet formed to conform to the shape of the doors. Although not illustrated, ceiling 12 is of standard construction of ceiling joists and plaster wall board with frame 14 covering a structural framed opening generally constructed of two by six inch lumber. Panel 16 is typically three-eighths to three-quarter inch plywood through which an opening is cut substantially the same shape, but slightly smaller than frame 20 leaving about one-half inch of plywood around the edges to receive screws 36 extending through holes 34 in the frame to hold device 10 on the bottom surface of the plywood sheet. Doors 22 and 24 may be replaced by a single door hingeably attached at one end, but two doors are preferred. Eye bolts 32 are connected and extend downwardly from the bottom surfaces of each door close to the joint center line between the two doors. Hook wand 18, more clearly illustrated in FIG. 5, is a metal wand about two feet long with hook 38 at one end to hook through the openings in eye bolts 32 to easily allow doors 22 and 24 to be pulled downwardly to open the doors or to push them back up into their closed positions. In FIG. 4, the enlarged view shows doors 22 and 24 swung openly to expose louver screen 26, the louver members being angled at about forty-five degree angle. On the inside of the doors are insulation boards 38 on door 22 and insulation board 40 on the inside of door 24 to reduce heat loss during the winter when the doors are kept closed. Magnets 42 abut and attach to frame 20 to keep door 22 in place while magnets 44 attach to the frame and keep door 24 in the closed position. Frame insulation 48 as shown in the cross-sectional view of FIG. 7 as well as the back view in FIG. 6 reduces heat loss conduction through the frame member during the winter time. The surface of device 10 shown in FIG. 6 is abutted against end plywood panel 16 and is held in position with screws 36 through holes 34. The opening through plywood panel 16 is cut to the dimensions of inside peripheral edge 50 of the inside opening of frame 20 after which device 10 is attached in place.

While this invention has been described with reference to the specific embodiments disclosed herein, it is not confined to the details set forth and the patent is intended to include modifications and changes which may come within and extend from the following claims.

I claim:

1. A method to provide ventilation in a living structure through a ceiling above which is an attic space having a roof fan pulling air from said space to the outside, wherein there is an access opening through the ceiling to the attic space, the access opening being open and closed with a closure means comprising a panel member, the method comprising:

(A) providing a ventilating device comprising:

(i) a frame member having outside dimensions smaller than that of the panel member, two opposite ends and a first surface, (ii) a central opening through the frame member, (iii) at least one door hingeably attached proximate one end of the frame member swinging outwardly from the frame member to an open position opening the central opening and swinging back to the frame member to a closed position to close the central opening, (iv) screen means across the central opening to at least partially obstruct sight through the central opening while allowing essentially unobstructed air flow, (v) closure means to hold the door in the closed position, and (vi) opening means to allow a person to open the door without climbing;

(B) cutting an opening through the panel member of a size and shape proximate that of the central opening through the frame member of the ventilating device, (C) placing the first surface of the ventilating device against the frame member aligning the central opening with the opening through the panel member, and (D) attaching the frame member to the panel member,

2. The method of claim 1 wherein the central opening is rectangular and the cutting through the panel member is of a rectangular opening.

3. The method of claim 1 wherein the closure means comprises a magnet and closing the door comprises swinging the door upwardly to engage the magnet.

4. The method of claim 1 wherein the ventilating device comprises a pair of doors, one door hingeably attached proximate one end of the frame and the remaining door hingeably attached proximate the opposite end of the frame, the combination of the two doors closing the central opening of the frame.

5. The method of claim 1 wherein the opening means comprises a member having an eye opening, the member extending downwardly from the door and a hand held rod member with a hook on an end, and the method further comprises opening the door by engaging the hook in the eye opening and pulling to open the door.

6. The method of claim 4 wherein the opening means comprises a pair of members each having an eye opening, the members extending downwardly from opposite doors and a hand held rod member with a hook on an end, and the method further comprises opening the doors by engaging the hook on one of the doors in the eye opening and pulling to open the door and then engaging the hook on the remaining door in the eye opening and pulling to open the remaining door.

7. The method of claim 1 wherein the ventilating device further comprises at least one insulation panel on a surface of the door facing a same direction as the first surface of the frame and the method further comprises opening the door.

8. A ventilating device comprising:

(i) a rectangular frame member two opposite ends, (ii) a rectangular central opening through the frame member, (iii) a pair of doors, a first door hingeably attached proximate one end of the frame swinging outwardly in a first direction from the frame member to an open position and a second door hingeably attached proximate the opposite end of the frame swinging outwardly in the first direction from the frame member to an open position, both doors swinging back to the frame member to a closed position to close in combination the central opening of the frame, (iv) screen means across the central opening to at least partially obstruct sight through the central opening while allowing essentially unobstructed air flow, (v) closure means to hold the door in the closed position comprising at least one magnet on each door position to engage the frame member when each door is swung to the closed position, and (vi) opening means to allow a person to open the doors without climbing comprising a pair of members each having an eye opening, each of the members attached to and extending in the first direction from each of the doors proximate an end furthest away from the hingeable attachment and a hand held rod member at least one and half feet long with a hook on an end.

* * * * *